United States Patent [19]

Tschirky

[11] 3,975,120

[45] Aug. 17, 1976

[54] WAFER ELEMENTS FOR PROGRESSING CAVITY STATORS

[75] Inventor: John E. Tschirky, Long Beach, Calif.

[73] Assignee: Smith International, Inc., Newport Beach, Calif.

[22] Filed: Nov. 21, 1974

[21] Appl. No.: 525,828

Related U.S. Application Data

[63] Continuation-in-part of Ser. No. 415,754, Nov. 14, 1973, and a continuation-in-part of Ser. No. 433,540, Jan. 15, 1974, Pat. No. 3,912,426, and a continuation-in-part of Ser. No. 525,400, Nov. 20, 1974.

[52] U.S. Cl. ..... 418/48

[51] Int. Cl.[2] ..... F04C 1/06; F04C 5/00

[58] Field of Search ..... 418/48

[56] References Cited

UNITED STATES PATENTS

| | | | |
|---|---|---|---|
| 3,652,192 | 3/1972 | Kramer et al. | 418/248 X |

FOREIGN PATENTS OR APPLICATIONS

| | | | |
|---|---|---|---|
| 735,690 | 6/1966 | Canada | 418/48 |
| 1,275,697 | 10/1961 | France | 418/48 |

*Primary Examiner*—C. J. Husar
*Assistant Examiner*—Leonard Smith
*Attorney, Agent, or Firm*—Subkow and Kriegel

[57] ABSTRACT

Progressive cavity motor with polyfoil stator assembled in a wafer array and method of formation of said stators.

24 Claims, 32 Drawing Figures

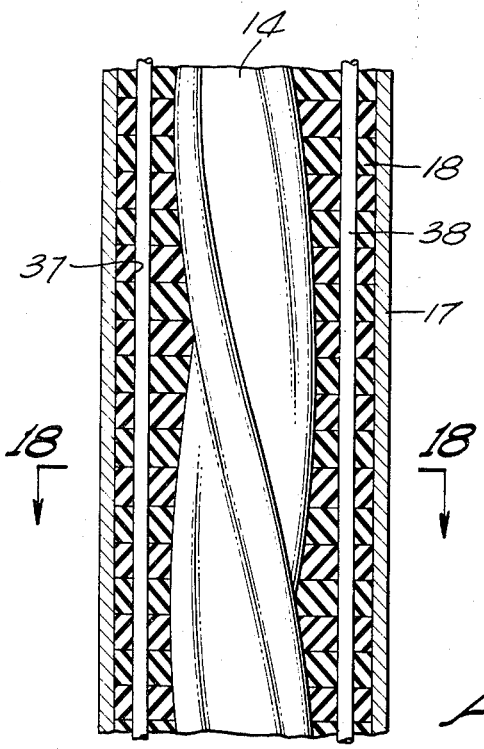
FIG. 16.
FIG. 18.
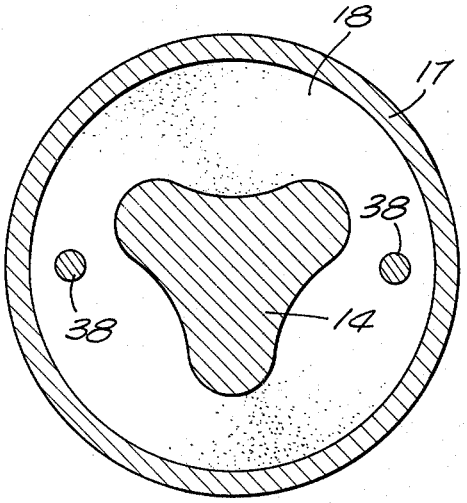
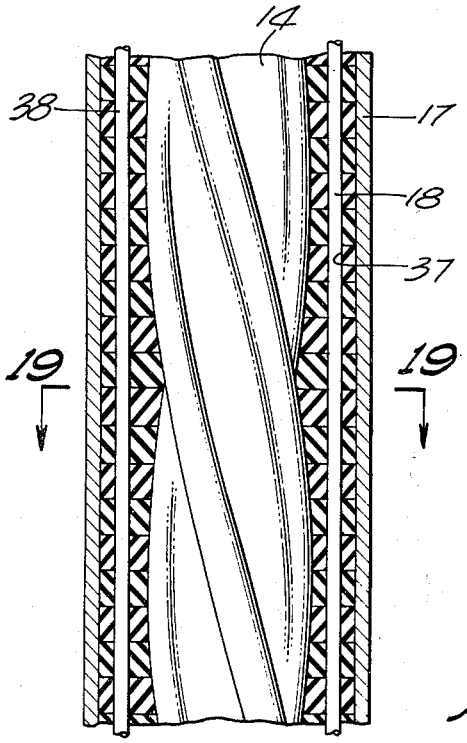
FIG. 17.
FIG. 19.
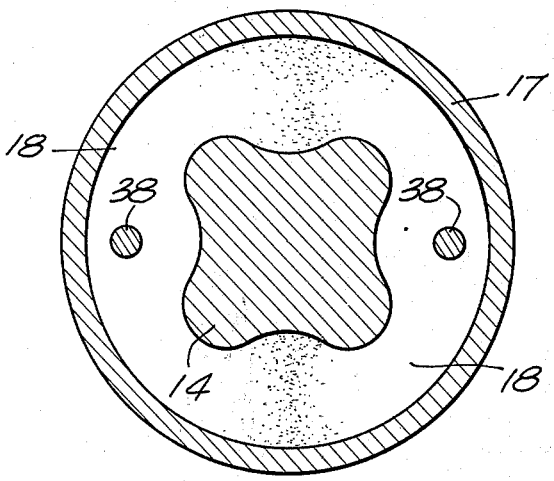

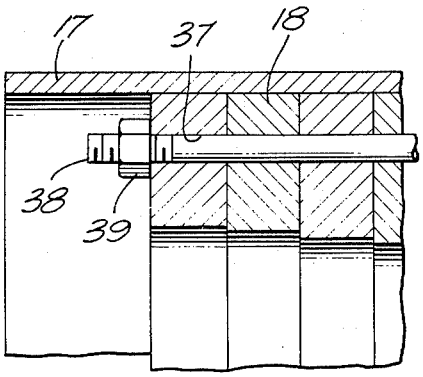
FIG. 21.
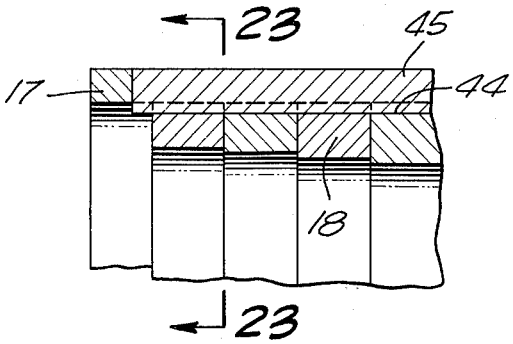
FIG. 22.
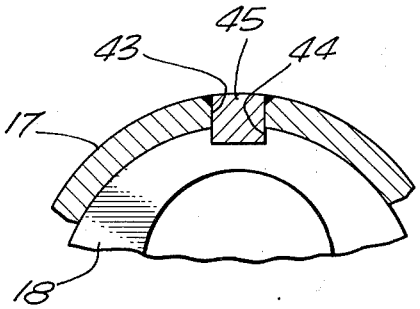
FIG. 23.
FIG. 24.
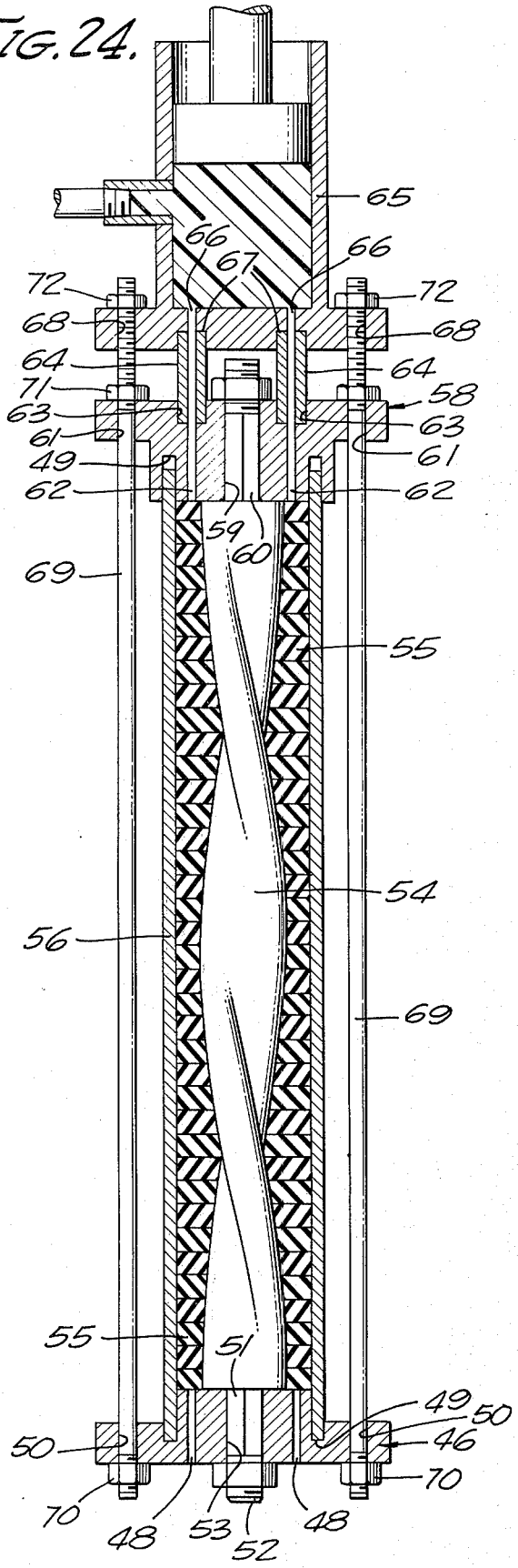

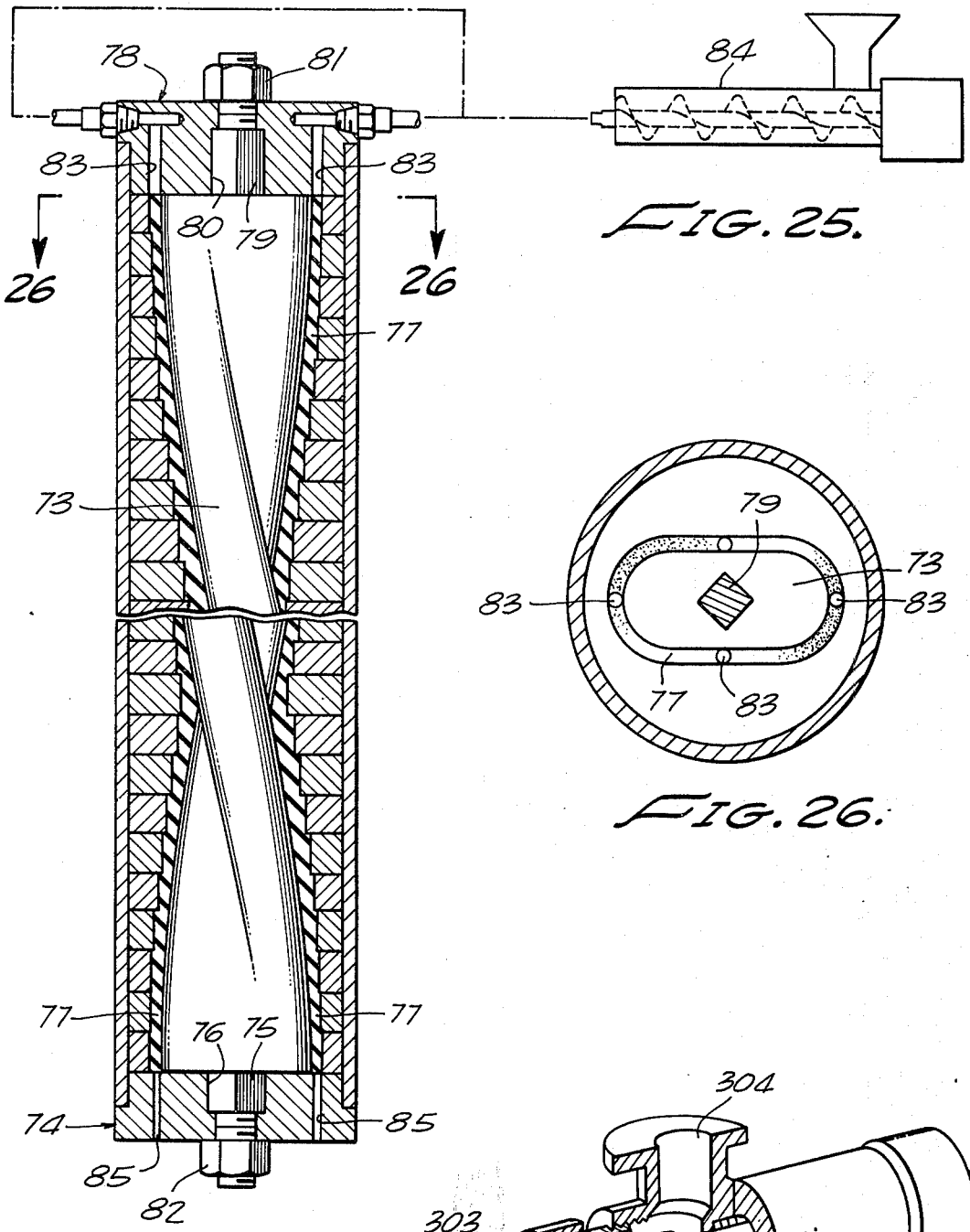
FIG. 25.
FIG. 26.
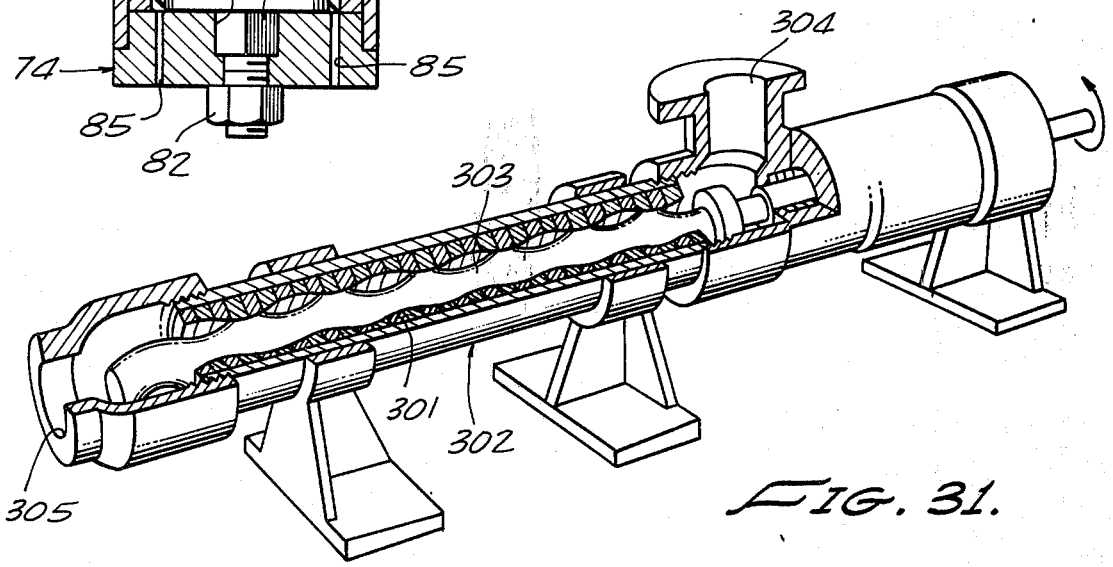
FIG. 31.

WAFER ELEMENTS FOR PROGRESSING CAVITY STATORS

This application is a continuation-in-part of application Ser. No. 415,754 filed Nov. 14, 1973, and application Ser. No. 433,540 filed Jan. 15, 1974, and now U.S. Pat. No. 3,912,426, and of application Ser. No. 525,400, filed Nov. 20, 1974.

This invention relates to progressive cavity transducers composed of a helicoidal rotor and a complementary helicoidal stator. When the rotor is rotated by an external force, the transducer acts as a pump, moving fluid from an inlet to an outlet connection to the stator. When the fluid is forced to flow between the stator and the rotor from the inlet to the outlet, the transducer acts as a motor delivering rotary power at the end of the rotor adjacent the discharge end of the fluid from the stator.

In a well-known form of such transducer, both when acting as a pump and when acting as motors, the stator is formed of an elastomer hereinafter referred to as a rubber, bonded to a steel housing.

When the transducer acts as a pump, rotation is imparted to a shaft to rotate the rotor; and fluid introduced at one end of the stator is pumped through the stator to an outlet connector to the stator. When fluid is forced into the stator between the rotor and the stator, it rotates the rotor, and the shaft connected thereto is then a power takeoff point. Since the rotor of the transducer rotates in an eccentric manner, moving from side to side inside the stator, it is necessary to convert this motion into a true rotation about a fixed axis so that power may suitably be imparted to or taken from the rotor. This is accomplished by connecting the end of the rotor to a connecting rod by means of a universal joint and connecting rod to a shaft by means of a second universal joint to permit the shaft to rotate about a true axis. Such transducers have been for many years used in pumps under the trademark "Moyno" in this country by Robbins & Myers, Inc. of Springfield, Ohio, also Moineau U.S. Pat. Nos. 2,028,407 and 2,892,217. They have been used as motors in bore-hole drilling (see the Clark U.S. Pat. No. 3,112,801, patented Dec. 3, 1963) and have been widely distributed by Smith International, Inc., under their registered trademark Dyna-Drill. Such motors are described in the article by H. M. Rollins "Bit Guiding Tools Provide Better Control of Directional Drills," World Oil Journal 1966, pages 125–135; the Garrison U.S. Pat. No. 3,576,718, etc.

The prior art methods of construction of stators have placed a limitation on the length and the diameter to length ratio of the stators. This arises from several factors inherent in the molding techniques which are employed.

In a common method for forming the stators, the cylindrical housing containing a suitable core is used as a mold. The internal surface of the housing is sandblasted, degreased, and carefully and evenly coated with a cement. The rubber mix is heated to a suitably high temperature and forced into the space between the housing and the core. The rubber is cured and the core withdrawn.

This procedure has inherent limitations which place a practical limit on the size of the stator. The force necessary to introduce the rubber depends on the length and volume of the space to be filled. Since the rubber in order to be sufficiently plastic for proper filling must be retained at a high temperature, a long housing may cause the rubber to cool down, as it is filled, sufficiently to interfere with proper filling.

Another problem with long housings is the danger of an inclusion. Furthermore, the rubbing of the rubber compound against the wall of the housing, during filling strips cement from the internal surface causing poor adhesion with the danger of failure.

Employing housings of substantial length, it is practically necessary to fill them when the unit is held horizontally. Where the core is unduly long, the core may sag at an intermediate area causing uneven thickness of rubber to be applied. The resulting stator is thus asymmetric in the area of the sag.

The transverse thickness of the mass of rubber which makes up the stator, especially in stators of undue length, requires excessive pressure to force the rubber into the mold.

Because of these limitations, it has not been practical to produce stators in excess of 16 feet in length and stators with a length to housing diameter ratio of about 30:1. Stators have been limited to housing diameters of about 14 inches maximum.

The use of such motors in bore-hole drilling, especially in drilling for oil and gas but also mining operations, has been a standard procedure in the art. Such motors are employed to rotate drills for boring in the earth. The motors may be used in an oil-field operation, such as tube cleaning, milling operations, and other conventional oil-field operations where it is desired to rotate a rod at the end of which a tool is to be rotated. Such motors are referred to as in-hole drills when designed to be run at the end of a pipe and adjacent to the drill bit to rotate with respect to a stator which, in turn, is connected to the conventional drill string composed, in the case of the drilling of well bores, of a "kelly," drill pipe, and drill collar as required. The string extends to the surface with the kelly mounted in the rotary table. Where the in-hole motor is used in drilling, the liquid is the usual drilling fluid, i.e., mud or gas. It serves its usual function in the drilling operation, returning to the surface carrying the cuttings resulting from the drilling operation. For this purpose, it is necessary to provide the necessary fluid volumetric velocities (gallons per minute, G.P.M.) at the bit nozzles; and the necessary pressures at the nozzle so that cuttings may be moved through the annulus between the drill string and the bore hole wall and thus to the surface.

In motors used in connection with the earth-drilling operations, the pressure drop across the stator may be of the order of several hundred pounds with the drilling mud flow through the stator, from about 20 to about 1200 G.P.M.; the total pressure at the outlet of the stator depends upon the depth, nature of the mud, size of the tool, design of the nozzles of the bit. The bit manufacturer usually supplies a recommended nozzle pressure drop to give the required lifting effect. It has been observed in transducers and particularly in motors which deliver a substantial torque effort at the drive shaft that the rubber of the stator frequently fails near the fluid outlet point of the stator, and this usually occurs in the lower third of the stators.

This effect appears to be related to the working of the rubber by the eccentric motion of the rotor and the magnitude of the pressure drop across the stator. The resultant hysteresis in the substantial mass of rubber required in the stator deleteriously affects the properties of the rubber.

An additional problem with rubber stators is in the influence of the geothermal effect. The temperature in the bore hole may range up to several hundred degrees Fahrenheit above ground temperature, depending on the depth. This adds to the heat developed by the working of the rubber mass, due particularly to the low heat conductivity of the rubber mass, which is thus not readily carried away by the circulating mud.

A further problem which causes rubber deterioration arises from the chemical effect of oils of paraffin nature on the swelling of the rubber mass and its deterioration.

Despite the cooling effect of the fluid, this temperature taken together with the working of the rubber which develops a hysteresis in the rubber, operates to impair the physical properties of the rubber. The result is a reduction in the life of the stator, and it is frequently necessary to replace stators with undue frequency which may be more frequent than any other effect requiring the withdrawal of the motor from operation and thus adding to the cost of operations.

Another influence which deteriorates the properties of the rubber is the swelling effect of the oil on the rubber mass where the motor is employed in oil producing bore holes. This is particularly aggravated by low aniline point oil.

The result is a loss of portions of the rubber which break away from the body of the rubber called "chunking" usually at its lower third or it may strip away from the encasing housing due to bond failure, or both may occur.

When this occurs, the motors must be disassembled and a new stator installed. This stator must, of course, have the necessary pitch to complement the rotor and give the required pressure drop.

The torque developed is the greater the greater the effective pressure drop across the stator. For any given throughput, i.e., G.P.M., the pressure drop will be the greater the greater the length of the stator, the less the leakage factor and the greater the diameter of the rotor which requires a greater diameter stator, all other design parameters being the same.

However, as discussed previously, there is a practical limit on how large a stator can be molded.

In view of the above practical limitations, the ratio of the stator length in inches to the stator housing diameter does not exceed about 30:1. For example, for the widely used 5 inches motor, the maximum length which is practical is 13 feet. Stator lengths ranging from 30 inches to 16 feet have been employed, depending on the stator housing diameters, which have practically been from 1¾ inches to 14 inches. The usual stator pitches have been from ¾ foot to 8 feet, depending on the required rotor diameter and service to which the motor is to be applied.

The leakage factor referred to above is the result of bypass of the fluid entering the stator, which passes between the rotor and the stator and does not progress with the main body of fluid which results in the torque produced at the end of the rotor. The efficiency of the motor is proportional to the fraction of the volume of fluid which is introduced into the stator which generates the torque. This will be discussed more fully below.

In the prior art motors using rubber bifoil stators and helicoidal rotors such as referred to above, the leakage factor may be up to 10% and higher.

In order to minimize this leakage to an acceptable percentage, which for all practicable purposes may be taken as under 5 percent and preferably not more than about 2 percent, the diameter of the rotor is made somewhat larger than the minor axis of the bifoil. This interference fit introduces a substantial friction loss and reduction in mechanical horsepower delivered by the rotor.

However, for many uses, it is desirable to develop a greater torque than is now practically available.

Where the motor is used as a down-hole motor in earth boring, as stated above, the requirements of the system include a sufficient flow, i.e., gallons/minute (G.P.M.) of mud or other fluid flow in order to establish the necessary velocity through the bit orifices and thus the desirable fluid velocity in the annulus to raise the detritus. This requires a sufficient pressure at the output of the stator so as to provide the necessary pressure and volumetric flow of the fluid at the bit nozzles.

Since for any fluid rate, gallons per minute, in any particular stator-rotor combination, the revolutions per minute (R.P.M.) is fixed, being directly proportional thereto, the torque is proportional to the pressure drop across the stator. These considerations influence the minimum pressure drop which can be tolerated and obtain the necessary fluid velocities and pressures at the bit nozzles.

In order to increase the torque, the product of the eccentricity (E) and the rotor diameter (D) and the stator pitch ($P_s$) and the effective pressure drop ($\Delta p$) across the stator must be increased, since the torque is directly proportional to this product. In the case of oil-well or other bore-hole drilling, the size of the bore hole fixes the size of the diameter of the rotor (D) and eccentricity (E) which is practically available. The increase in the pressure drop ($\Delta p$) may be obtained by increasing the flow resistance through the stator by increasing the length of the stator. While this will result in an increase in the torque, it may be impractical because of stator molding problems. If the torque is increased by making the product ($E \times D \times P_s$) greater, the R.P.M. is decreased, at a constant G.P.M.

This dichotomy has introduced a practical limitation in the power available from prior art motors of this character when used as bore-hole in-hole motors. This limitation taken with the reduction in stator life resulting from use of excessive pressure drop has been one of the limitations in this technology.

STATEMENT OF THE INVENTION

My invention relates to a novel stator and method of construction of stators which permits of the construction of stators of any desired length, pitch, and stator diameter and cross section shape. It also relates to transducers employing such stators.

It avoids the problems inherent in the conventional unitary stator and the molding techniques described above.

In carrying out my invention, stator elements are used which have integral cross-sectional shape of the desired stator configuration but of dimension substantially less than that of the desired stator. The stator sections are stacked one on top of the other in a multiple longitudinal array. They are arranged so that their internal surface when assembled in the above longitudinal array produces the required surface of the stator. The array is held in place so that when assembled the individual wafers are not displaced in use.

In order to assemble the stator elements, they are threaded over a male form whose surface is topologically congruent with the stator surface that is desired, which the stator elements generate when they are assembled.

The individual stator elements may, depending on their composition, be of any thickness less than the pitch length of the stator. They may be of length such as they may be conveniently made and avoid the fabrication problems of the long stators referred to above. When assembled on the form, they may be joined to form one assembled stator.

However, I prefer to employ the elements as thin wafers, such that their axial dimension is a small fraction of the pitch length. I may thus form the wafers by any convenient method known to the art in forming washers, but having the internal surface configuration required so that when they are assembled in a longitudinal array they generate the required stator surface.

The wafers are secured together so as to form them into a rigid stator.

I may also employ wafers having an inner surface substantially perpendicular to the upper and lower surface of the wafer. I prefer to employ the wafers with longitudinal axial dimension, i.e., thickness such that in practical effect the inner surface is congruent to the contiguous external surface of the form as will be more fully described below. This is particularly the case where the wafer is metallic and in the absence of rubber interface between the metallic wafer and the form. In the former case, i.e., of an entirely metallic wafer, I may make the internal surface of the wafer a helical section corresponding to the form of the internal stator surface and limit the axial thickness to a small fraction of the pitch length.

Stated in another way, in the case of the metallic wafer the axial thickness of the wafer is desirably about 5 percent or less of the pitch length of the stator to be formed. The rubber wafer and the rubber-coated or encapsulated wafers may be of greater width, for example, from about 0.5 percent to about 5 percent of the pitch length ($P_s$) of the stator.

In the stator of my invention, the internal surface of the wafers may be coated with an inner rubber liner of the internal helical surface of the stator.

This invention will be further described in connection with the following figures.

Figure 1:
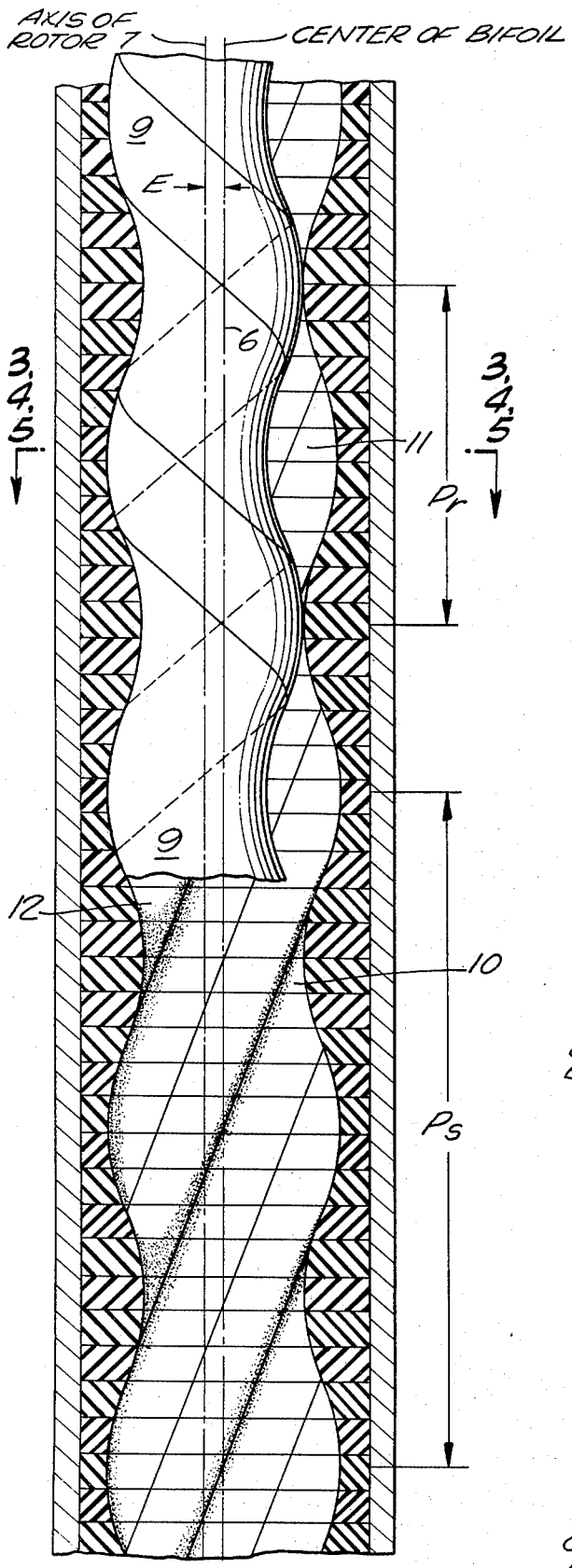
FIG. 1 is a fragmentary cross section through a transducer employing a stator formed with a helicoidal inner surface, according to my invention, composed of section members herein referred to as wafers.
Figure 3:
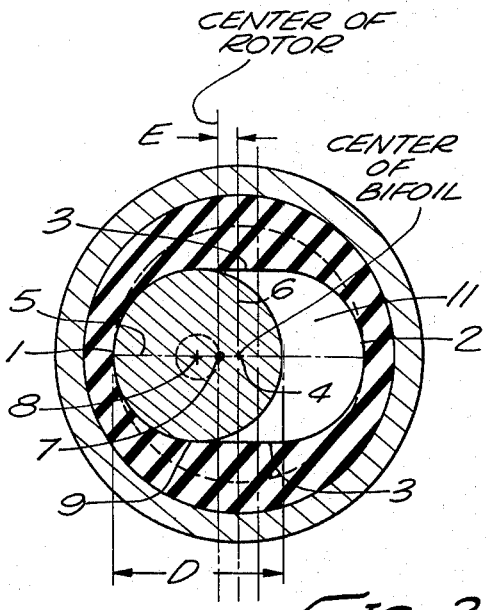
Figure 4:
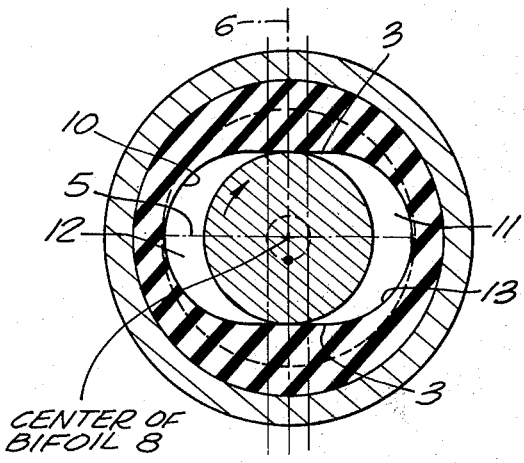
Figure 5:
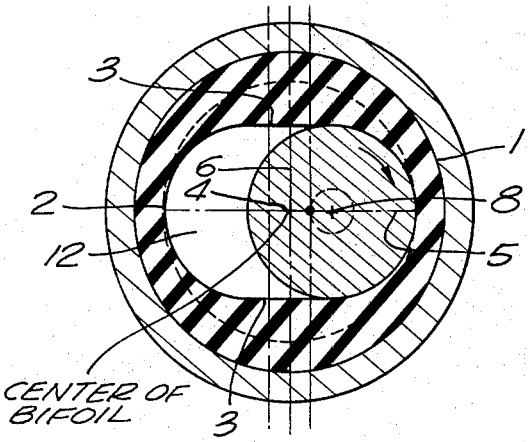
Figure 2:
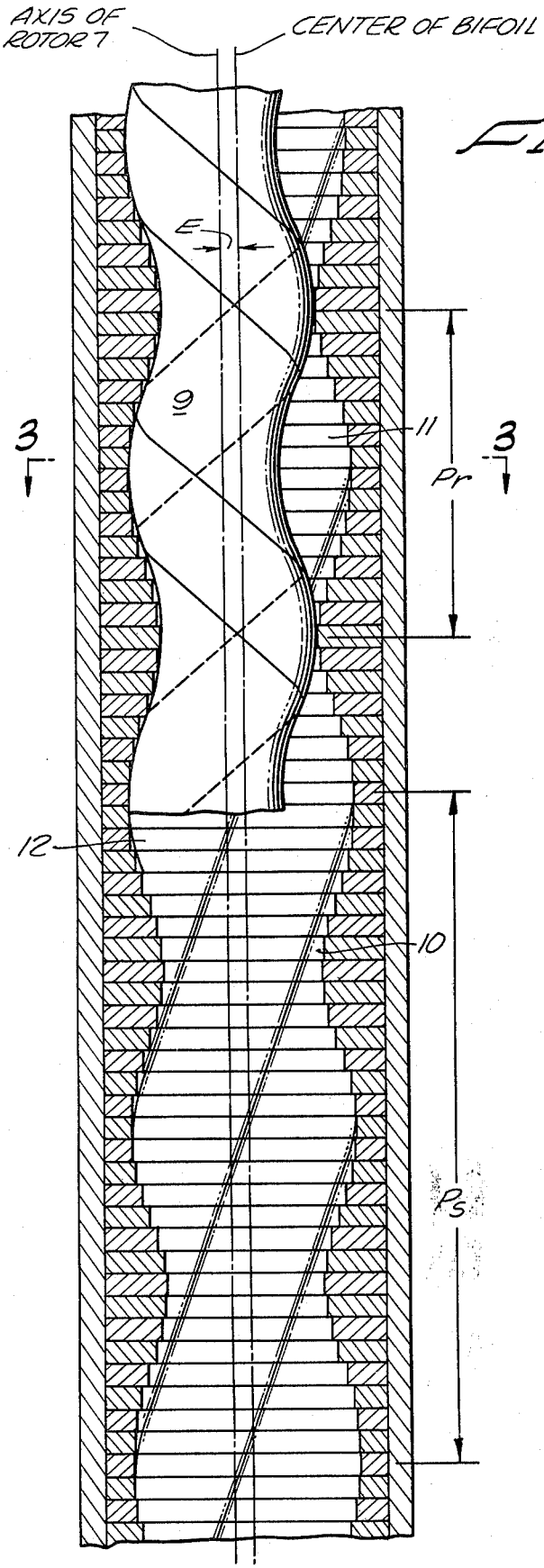
FIG. 2 is a view similar to FIG. 1, employing a straight-sided wafer, according to my invention.

FIGS. 3, 4 and 5 are sections taken respectively on lines 3—3, 4—4 and 5—5 of FIG. 1 or FIG. 2.

Figure 6:
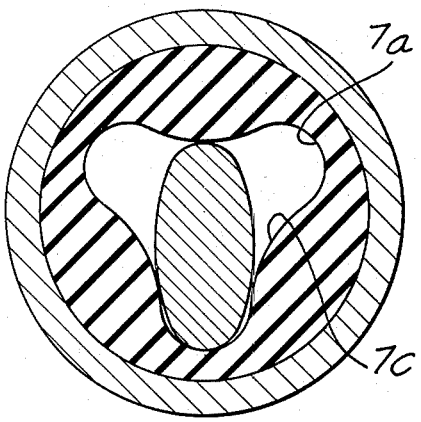

FIG. 6 is a section similar to FIG. 3 of a transducer, employing a trifoil stator formed of wafers, according to my invention.

Figure 7:
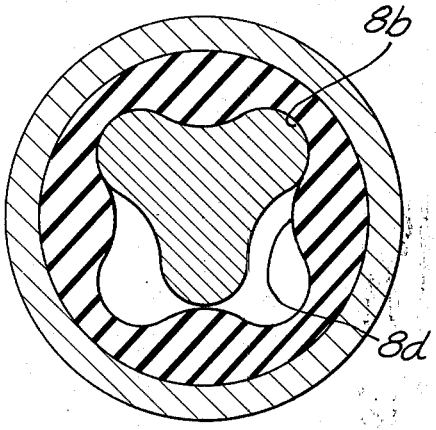

FIG. 7 is a view similar to FIG. 6, employing a quadrafoil wafer, according to my invention.

Figure 8:
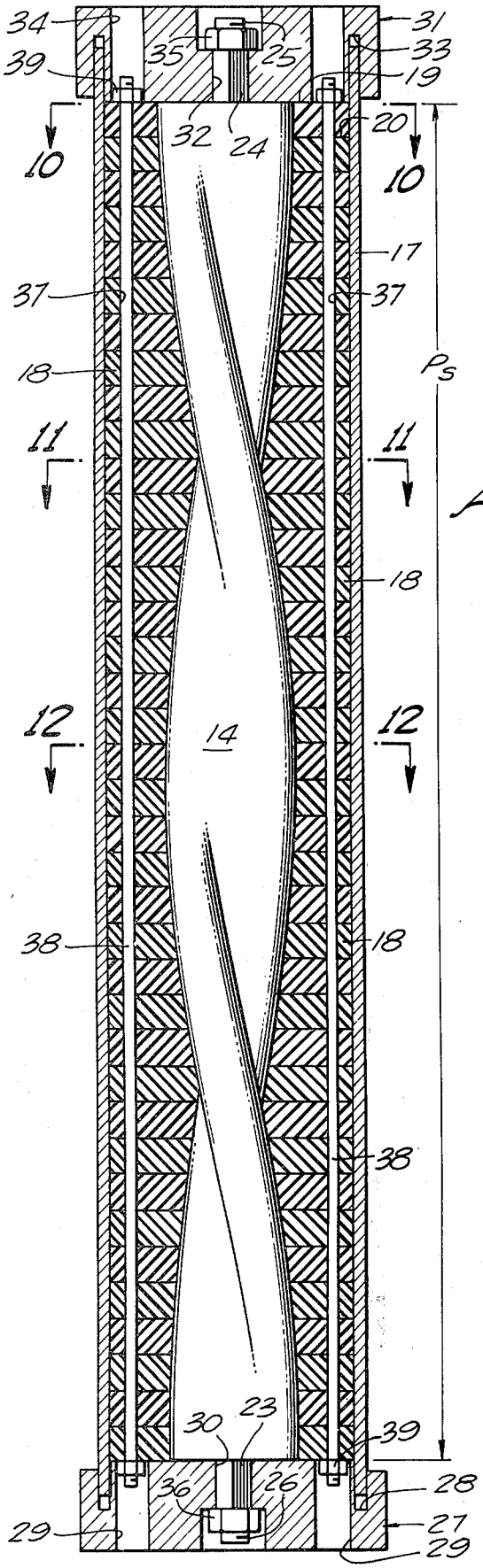

FIG. 8 is a vertical section of a helicoidal wafer array positioned on a bifoil form shown in elevation.

Figure 9:
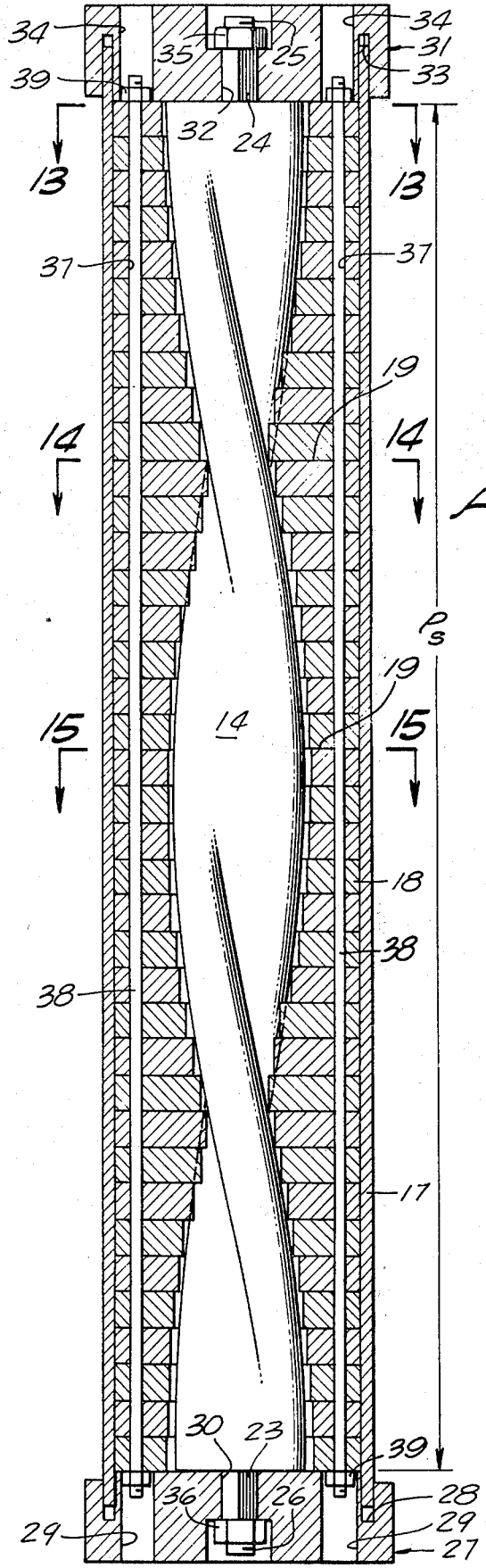

FIG. 9 is a view similar to FIG. 8, employing straight-sided wafers.

Figure 10:
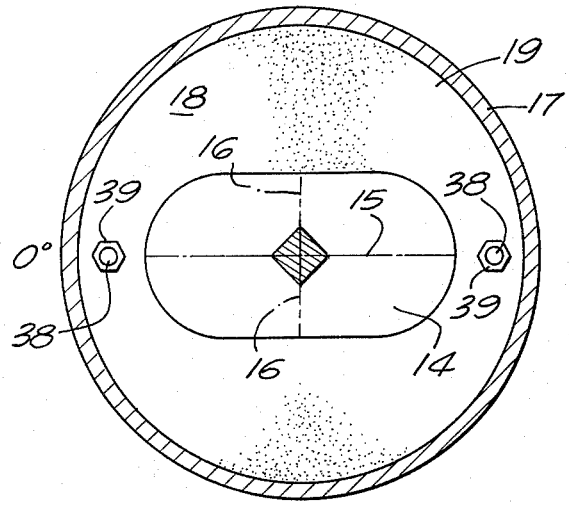

FIG. 10 is a section taken on line 10—10 of FIG. 8.

Figure 11:
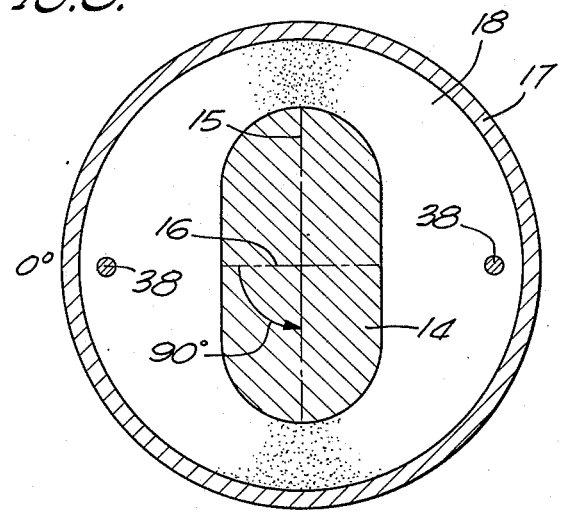

FIG. 11 is a section taken on line 11—11 of FIG. 8.

Figure 12:
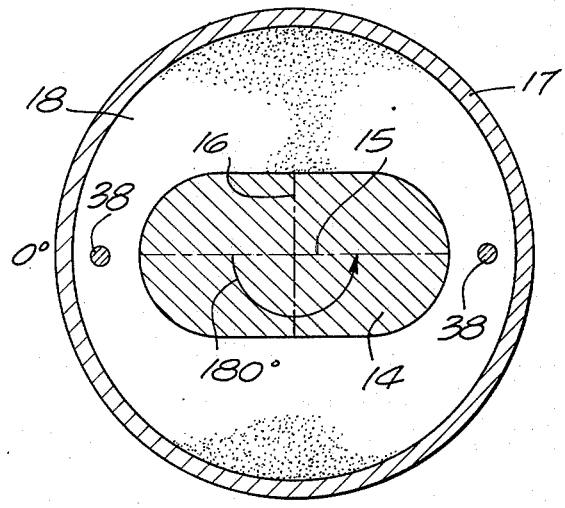

FIG. 12 is a section taken on line 12—12 of FIG. 8.

Figure 13:
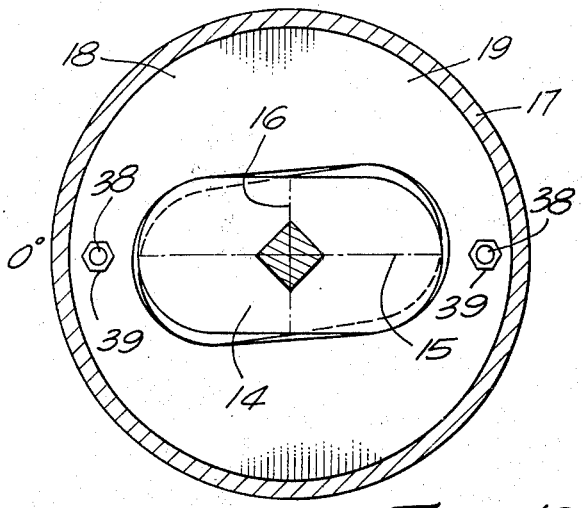

FIG. 13 is a section taken on line 13—13 of FIG. 9.

Figure 14:
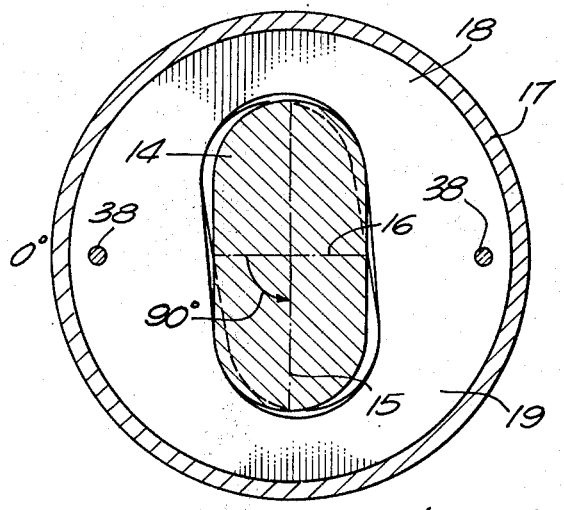

FIG. 14 is a section taken on line 14—14 of FIG. 9.

Figure 15:
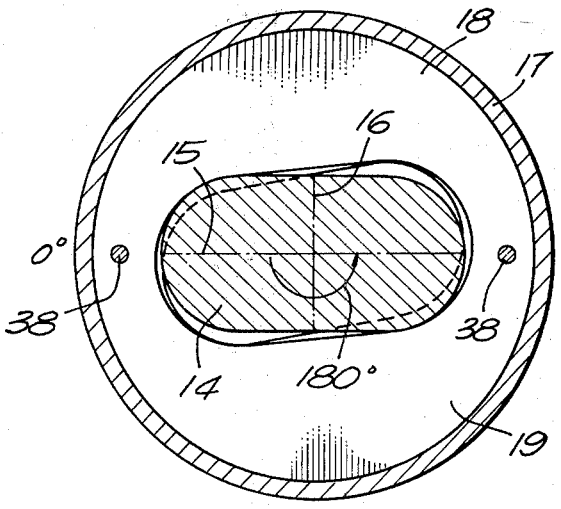

FIG. 15 is a section taken on line 15—15 of FIG. 9 180° displaced from FIG. 13.

FIG. 16 is a fragmentary section of a trifoil wafer array assembled in a trifoil form.

FIG. 17 is a fragmentary section of a quadrafoil wafer array assembled in a quadrafoil form.

FIG. 18 is a section taken on line 18—18 of FIG. 16.

FIG. 19 is a section taken on line 19—19 of FIG. 17.

Figure 20:
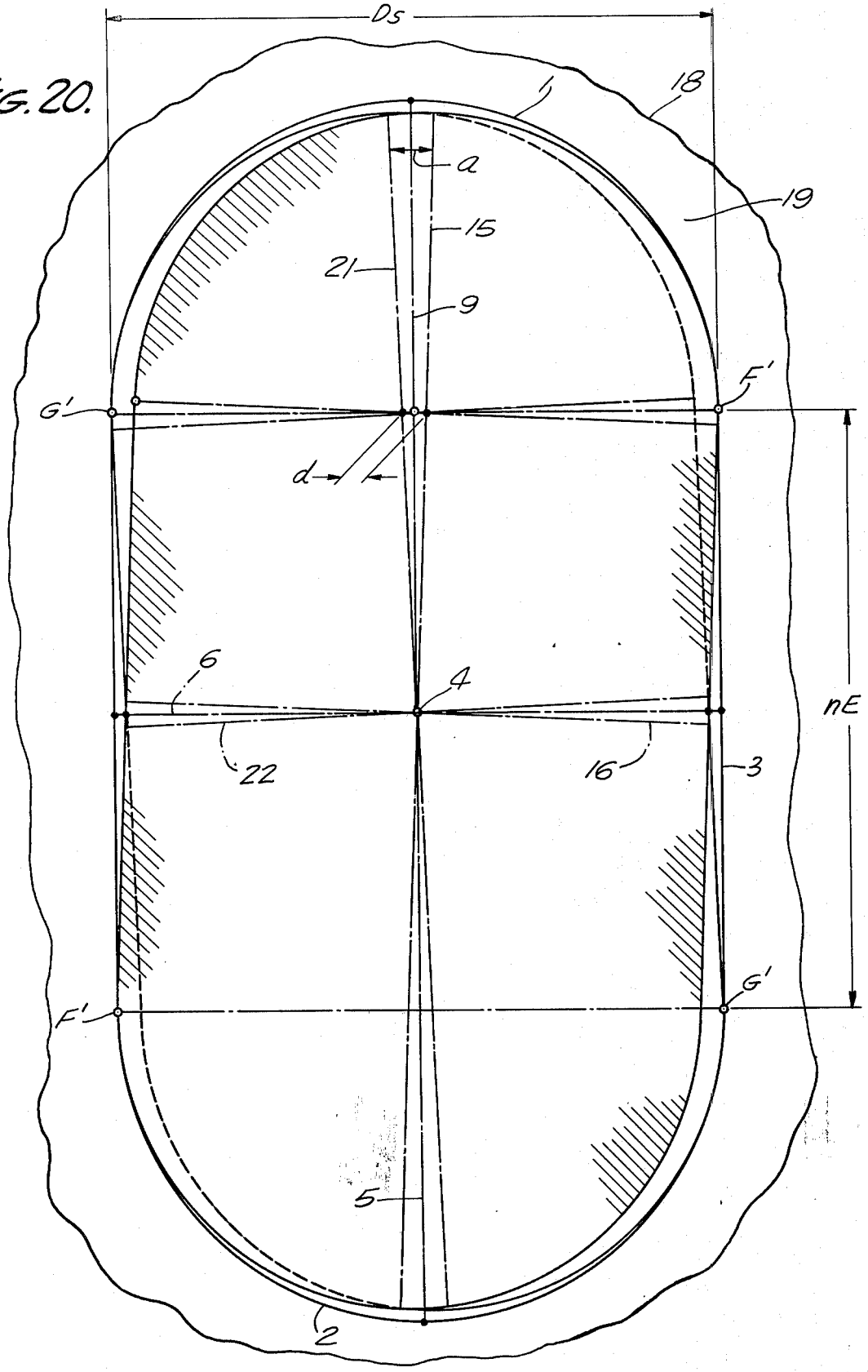

FIG. 20 shows an enlarged fragmentary detail of a straight-sided bifoil wafer mounted on a bifoil form similar to FIGS. 13–15.

FIG. 21 is a fragmentary section of a wafer array, according to procedure as in FIGS. 8 and 9.

FIG. 22 is a fragmentary detail of a further form of securing the array.

FIG. 23 is a fragmentary section taken on line 23—23 of FIG. 22.

FIG. 24 is a vertical section of an apparatus for bonding a wafer array.

FIG. 25 is a vertical section of an apparatus for assembling a straight-sided wafer array.

FIG. 26 is a section taken on line 26—26 of FIG. 25.

Figure 27:
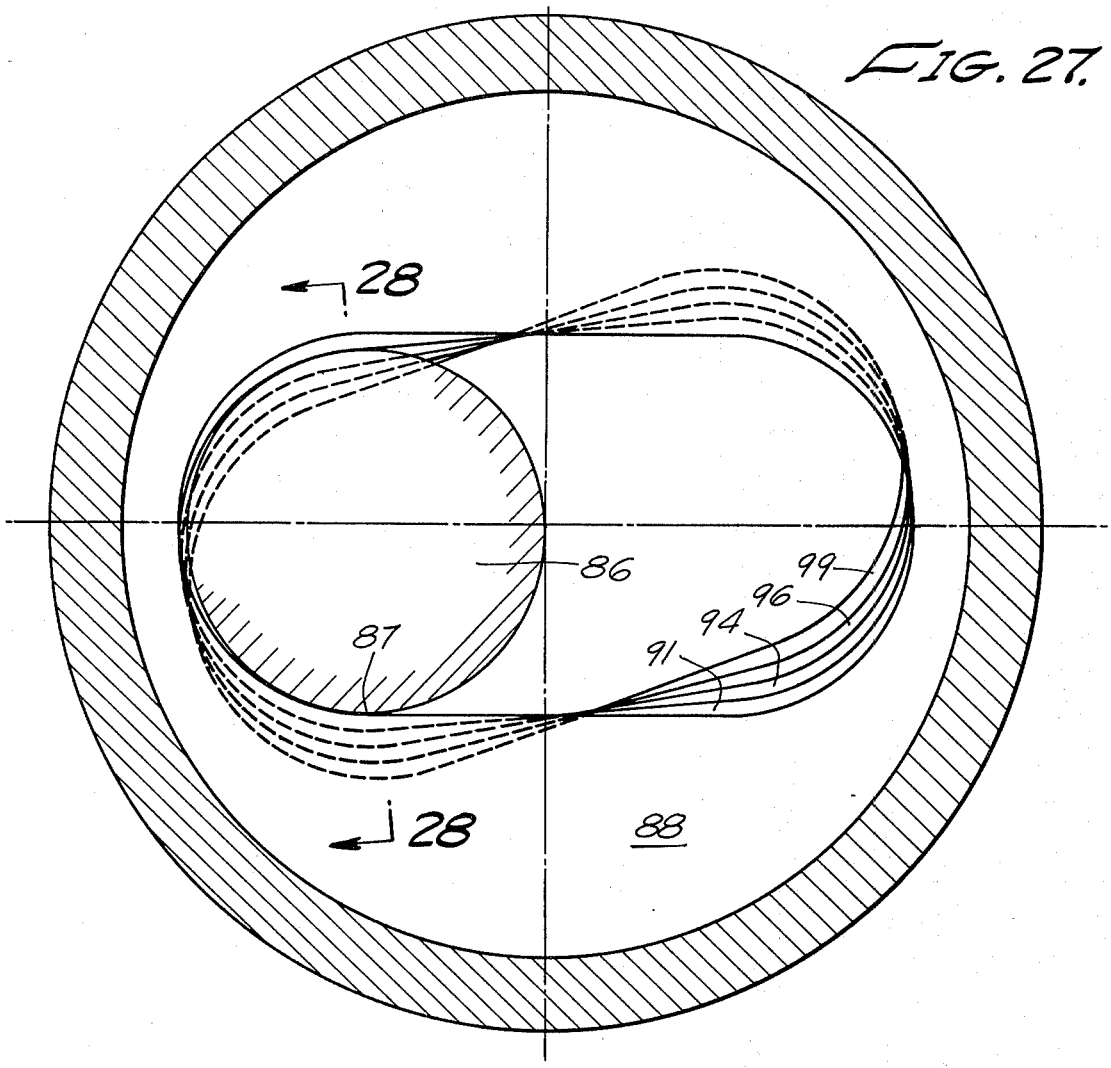

FIG. 27 is a section similar to FIG. 3 taken on line 3—3 of FIG. 2.

Figure 28:
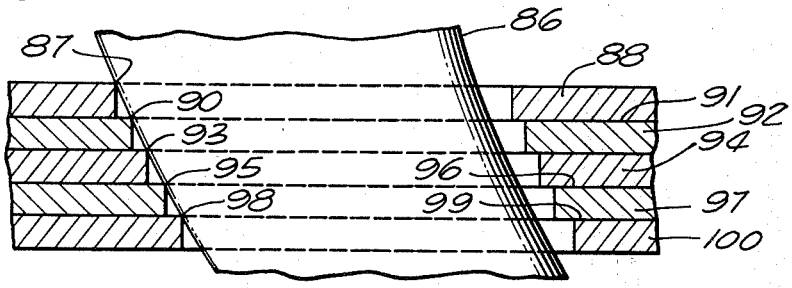

FIG. 28 is a fragmentary section taken on line 28—28 of FIG. 27.

Figure 29:
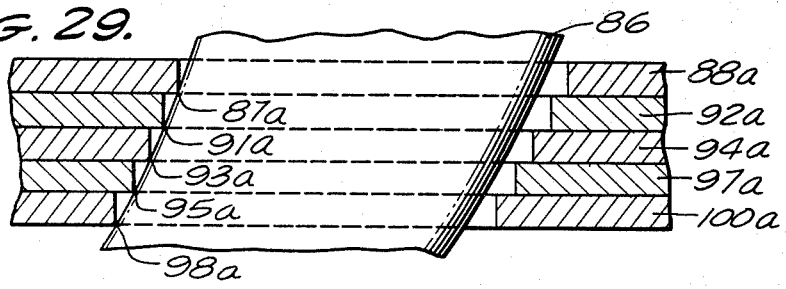

FIG. 29 is a section similar to FIG. 28, but taken at 180° of the pitch from FIG. 28.

Figure 30A:
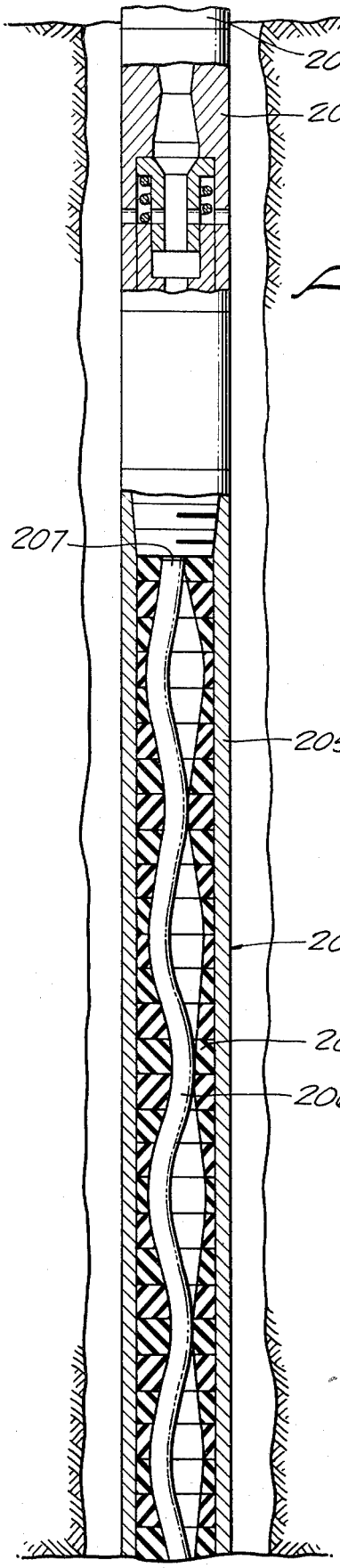
Figure 30B:
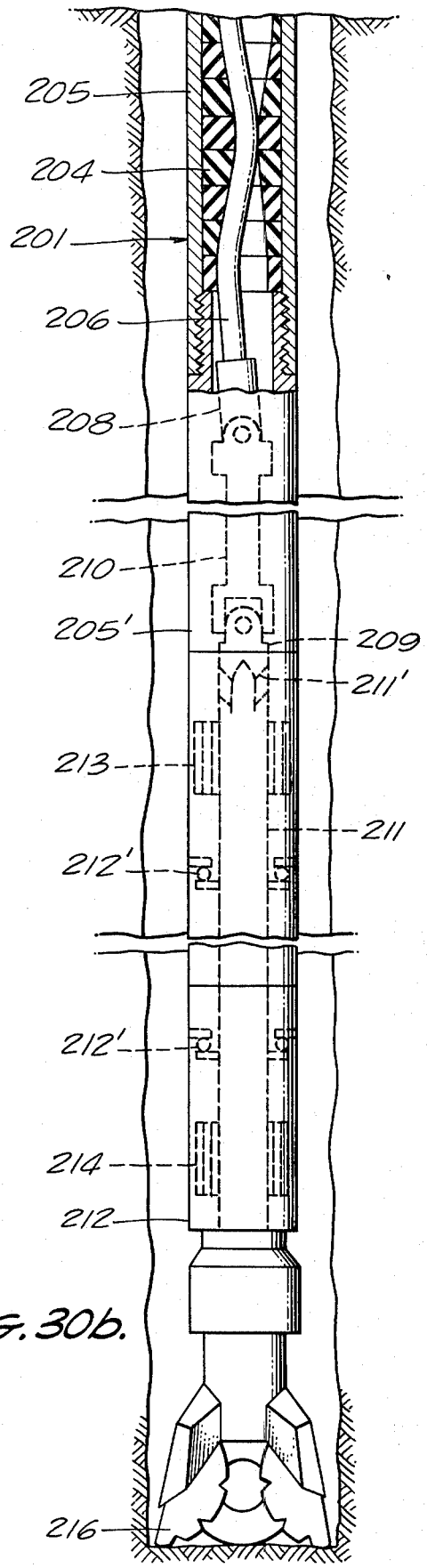

FIGS. 30*a* and 30*b* are a schematic view of the application of the transducer employing the stator of my invention.

FIG. 31 is a view of a different form of transducer employing the stator of my invention.

FIGS. 1–5 illustrate the design parameters of a bifoil rotor and stator assembly. The bifoil consists of two semicircular arcs 1 and 2 connected by tangents 3. The longitudinal axis of the bifoil is at 4. The major axis is at 5, and the minor axis perpendicular thereto is at 6. The diameter of each of the semicircles 1 and 2 at the minor axis is ideally equal to the diameter of the rotor which has a circular cross section of uniform diameter (D). The length of the tangent is equal to a multiple of the eccentricity (E) described below.

The longitudinal axis of the helicoidal rotor of pitch ($P_r$) is at 7. The rotor is symmetrical about this axis. The center 8 of each cross section of the rotor is on a helix parallel to the helicoidal external surface 9 of the rotor. On rotation of 90° of the rotor clockwise as viewed at FIG. 3, the rotor translates to position shown in FIG. 4; at 180°, it rotates to position shown in FIG. 5.

As shown in the form of FIGS. 1–5, the stator of pitch ($P_s$) is formed of a helicoidal bifoil groove 10 in the half section of the stator shown in FIG. 1. A similar helicoidal groove 13 is in the opposition half section, not shown on FIGS. 1 or 2. The grooves meet at the minor diameter 6 (see FIGS. 1–5).

As the rotor rotates and translates from the position in FIG. 3 to the position in FIG. 4, the cavity at 11 is connected with the cavity at 12 by the spiraled bifoil grooves in the stator. A further 90° rotation closes cavity 11 (see FIG. 5). On the reverse movement of the rotor, the cavity 11 and the next lower cavity 12 become interconnected; and the cavity 12 is closed.

In translating and rotating, the rotor executes an eccentric motion such that a point 7 moves in a circular path of radius E, i.e., the eccentricity of the rotor motion.

Where 4 may be the desired multiple $n$ of the eccentricity, the value ($n$E) is the eccentricity of the bifoil. The distance between the centers of the semicircular ends of the bifoil depends on the eccentricity and is equal to $n$E.

The parameters E, D, $P_s$ and $P_r$ are illustrated on FIGS. 1–5 and related so that the rotational angular velocity, i.e., $$\text{R.P.M.} = \frac{\text{G.P.M.} \times 231}{n(E \times D \times P_s)}$$

where $E$, $D$ and $P_s$ are in inches.

Where $n$ equals 4, the torque T is given $$T = 0.636 \times E \times D \times P_s \times K\Delta P \qquad K\Delta P = \Delta p'$$

where $\Delta p$ is the pressure drop across the stator, and $T$ is in inch-pounds, and $\Delta$P and $\Delta$p are in pounds per square inch.

The above analysis depends on the assumption that the cross section of the bifoil is such that the semicircles 1 and 2 are of a radius substantially equal to ($D/2$) and the minor axis 6 equal to ($D$) and that it is uniform throughout the length of the rotor in the stator. If the radius of the semicircle or half the dimension of the minor axis is substantially greater than $D/2$, fluid will bypass between the external rotor surface and the internal stator surface. Any non-uniformity in the pitch along the length will also result in a change either in the effective R.P.M. or the leakage. Such inaccuracies which may occur at random along the length of the stator due to molding deficiencies have been encountered in prior art molded stators in which the leakage, as described above, may be up to 10 percent of the fluid input to the rotor.

But to the degree that (G.P.M.)′ is not equal to (G.P.M.), the effective pressure drop $\Delta p$ across the transducer is reduced, reducing the torque.

The ratio (G.P.M.)′/G.P.M. = K the efficiency factor.

The result of this leakage is that the portion of the G.P.M. which bypasses as leakage reduces the G.P.M. input so that the effective (G.P.M.)′ which causes rotation is given by the following:

$$\text{R.P.M.} = \frac{(\text{G.P.M.})'}{n(E \times D \times P_s)}$$

the leakage plus the (G.P.M.)′ being the total throughput.

In addition to stators of bifoil cross section (FIGS. 1–5), the cross section of the stator may be a polyfoil of more than two lobes. Other cross-sectional forms may be employed. These are illustrated and their geometry described and analyzed in the Moineau U.S. Pat. Nos. 1,892,217, patented Dec. 27, 1932, and 2,028,407, patented Jan. 21, 1936, and in my co-pending application filed Nov. 20, 1974, Ser. No. 525,400.

The patent refers to the arcs 7*a* and 8*b* of FIGS. 6 and 7 as epicycloids and the arcs 7*c* and 8*d* as hypocycloids. This terminology is adopted in this specification.

My invention makes possible the production of stators in which the variation in the critical dimensions of the stator may be reduced to insubstantial amounts and if desired, within the permissible tolerances. My invention in a large measure will solve the problem of deterioration of the rubber resulting in chunking and stripping and thus increases the life of the stator element. It will eliminate the problem of molding the large unitary stators required to produce the torque which modern technology requires of such motors. In my preferred embodiment employing bifoil stators, contrary to the inflexibility of the present design of unitary stators in transducers employing bifoil stators, I may readily increase or decrease the torque by changes in the length of the stator by adding or subtracting wafer elements, thus increasing or decreasing the effective pressure drop across the stator ($\Delta p$).

In the present state of the art prior to my invention, it is not practical to form bifoil stators having ratios of length to major axis in excess of 30:1 as stated above. I may obtain stators having stator configuration and dimensions in excess of 30:1. Because of practical limitations when using unitary rotors, the practical difficulties of rotor construction make length to diameter D ratios in excess of 100:1 of limited practical value. Where, however, tandem motors as described and claimed in my copending applications Ser. No. 415,754 and Ser. No. 433,540 are employed, the torque may be increased as there described. The aforementioned applications of which this is a continuation in part are herewith incorporated by this reference.

The Form

The stator of my invention is formed by assembling the wafers of suitable design by threading them over a form of suitable design, for example, as shown in FIGS. 8, 9, 16, and 17, required for the assembly of the wafers. The cross section of the form corresponds to the polyfoil cross section of the stator to be formed and is of the same pitch length and number of pitches as the stator to be formed.

Where the wafer is a bifoil, a form 14, such as is shown in FIGS. 8 and 9, is employed. The form has a bifoil cross section as shown in FIGS. 10–15.

In FIGS. 10 through 15, the major axis is at 15 and a minor axis is at 16. All sections along the length of the forms will have the same cross-section configuration. Accepting the convention that the section of the wafer shown at FIGS. 10 and 13 is at 0 angle of the pitch of the form, the orientation of FIGS. 11 and 14 is at 90° of the pitch and that of FIGS. 12 and 15 at 180° of the pitch. The position at 270° is similar to FIGS. 11 and 14; and at 360°, it will be the same as at zero, that is, as shown in FIGS. 10 and 13.

The length of the form and, therefore, the number of pitches involved, depends on the length of the stator desired to produce the design torque.

The geometry of the form may be visualized as generated by the polyfoil cross section which progresses uniformally along the longitudinal axis of the form, while the axis of the cross section rotates about the longitudinal axis in a counterclockwise direction, making a 360° rotation in progressing one pitch length.

The stator is formed as is shown in FIG. 8 by threading wafers 18 all of the same dimension on a form 14, centrally positioned in a tube 17. The wafers 18 are thus oriented and stacked in a longitudinal array to produce the stator. The method and apparatus for assembly of the stator will be more fully described hereinafter.

The Wafer Design

The wall on the interior surface of the wafer may be topologically congruent to the adjacent surface of the form. Examples of such wafers are shown in FIGS. 8, 10–12, 16–19. The wafer of my invention has an internal surface which is helicoidal, i.e., congruent to the form surface or parallel to the longitudinal axis of the form and the polyfoil. Examples of such wafers are hereafter referred to as straight-sided, i.e., perpendicular to the plane of the wafer at the periphery of the polyfoil. Such wafers are shown in FIGS. 9, 13–15, and 20. In the former case, the cross-sectional dimensions of the interior surface and the pitch of the wafer (referred to as helicoidal wafer) are the same as that of the form, allowing for manfacturing tolerances if an interference fit is to be avoided.

The surface of the internal opening of the helicoidal wafer may be a helicoid of suitable pitch ($P_s$) which when the wafers are assembled side by side, preferably in vertical array, will generate the stator of desired pitch ($P_s$). The straight-sided wafers may, however, have an internal surface perpendicular to the parallel upper and lower surfaces of this wafer. In the usual case, the external surface of the wafer is a right (straight) cylinder.

The wafers may be formed of metal, for example, of sheet metal, preferably suitably flat. They may be formed of natural or synthetic polymers, such as rubber compounded to have suitable properties.

The wafers may be formed by stamping or broaching, the internal profile being formed perpendicular to the wafer surface, that is, vertical by conventional stamping mill practices. Where the internal surface is helicoidal, it may be formed by milling, broaching or stamping.

When the stator cavity is a bifoil, the cross section of the rotor is a circle as is illustrated in FIGS. 1–5. When the stator cavity is a trifoil, the stator has a cross section such as in FIG. 6. When the stator capacity is a quadrafoil, the stator cross section is as shown in FIG. 7. (See also FIGS. 2 and 8 of said Moineau U.S. Pat. No. 2,892,217.)

The Straight Wall Wafer

Referring to FIGS. 2, 9, 13–15 and 20, the wafer is designed so that the major and minor axes of the wafer are larger than the major and minor axis of the form, depending on the ratio of the height of the wafer to the pitch of the form, which, as stated, depends on the stator to be formed. The relationship in the case of the bifoil wafer is illustrated in the FIGS. 2, 9, 13–15 and 20.

FIGS. 13–15 and 20 illustrate the relation of the top and bottom surface of a straight wall wafer to the form. These surfaces or sections correspond to the top and bottom surface of the wafer in position on the form, and they are perpendicular to the the longitudinal axis of the form or cavity of the stator. The relationship shown in FIG. 20 will also correspond to all of these wafers assembled in the longitudinal array of FIG. 9, as is further illustrated in FIGS. 13–15.

The major axis 15 and the minor axis 16 of the bifoil form, in a plane of the wafer surface 19 (FIGS. 9, 13–15, and 20), for example, are displaced counterclockwise about the central axis 4 of the bifoil through an angle (a) from the major axis 21 and the minor axis 22 of the form at the upper surface 20 of the next lower wafer. The angle $a$ in degrees is given by the following formula:

$$a = \frac{360^\circ h}{P_s} \qquad \text{Equation 1}$$

where $h$ is the thickness of the wafer and $P_s$ is the pitch of the stator.

In order to pass the wafer over the form, the major axis and minor axis of the wafer must be greater than the major and minor axis of the form.

In designing the straight-sided wafer for a stator to be used with a rotor of diameter $D_r$ and having a tangent 3 equal to $n$E, the major axis 9 and the minor axis 6 of the wafer must be greater than the major and minor axis of the form to permit the wafer to clear the form.

As an example illustrative of my invention and not as a limitation thereof, the application of the above analysis gives the following design parameter:

For a 6½-inch external diameter transducer having a stator pitch ($P_s$) of 42.0 inches and a rotor pitch ($P_r$) of 21.0 inches and a 2-inch diameter minor axis with an eccentricity E of one-fourth the minor axis, i.e., $n = 4$, the following values for ($h$) and ($d$) are for various straight-sided wafers:

| Thickness of Wafer (h) | Minor Axis Form | Minor Axis Wafer | (d) | Major Axis Form | Major Axis Wafer |
|---|---|---|---|---|---|
| 1″ | 1.850″ | 2″ | 0.150″ | 3.850″ | 4″ |
| 1/2 | 1.924 | 2″ | 0.076 | 3.924 | 4 |
| 1/4 | 1.962 | 2 | 0.038 | 3.962 | 4 |
| 1/8 | 1.982 | 2 | 0.018 | 3.982 | 4 |
| 1/16 | 1.990 | 2 | 0.010 | 3.990 | 4 |
| 1/32 | 1.996 | 2 | 0.004 | 3.996 | 4 |
| 1/64 | 1.998 | 2 | 0.002 | 3.998 | 4 |

Considering practical tolerances, it would appear that for all practical purposes in such a stator all wafers of about one-eighth inch or less (for example, one thirty-second inch) thickness would be suitable for the conventional size stator with a rotor of a 2-inch diameter.

That is to say that if the value of $$\left[\frac{n}{2} E \sin a\right]$$

is about equal to the tolerance permitted in forming the form and wafer, the wafer corresponding to $$\left[\frac{n}{2} E \sin a\right]$$

or thinner wafers would be satisfactory.

Referring again to FIGS. 13–15 and 20, the wafers at the upper surface are in substantial contact with the form at only the region F′ at opposite ends of the semicircular diameter of the arcs 1 and 2.

Wafers at their lower surface are in substantial contact with the form at the opposite ends of the semicircular diameter in the region of G′. With all wafers of the same thickness ($h$), the geometry of the wafer in relation to the form is the same at all positions along the length of the form. For example, but not as a limitation of my invention, the ratios ($h/P_s$) may, for practical purposes, be between about 0.05 and about $4 \times 10^{-4}$.

The form thus orients the wafers notwithstanding that the minor and major axes of the wafer bifoil are greater than those of the form bifoil cross section.

The Helicoidal Wafer

Instead of a straight-sided interior wall or surface, the polyfoil may have a helicoidal surface of the pitch of the form, i.e., of the stator to be assembled.

In such case the surfaces of the wafer and the form may be topologically congruent. (See FIGS. 8, 10–12, 16 and 17.) The major and minor axes may be substantially equal to the major and minor axes of the form so as to permit the wafers to clear the form. The wafers when assembled on the form are oriented so that the lower surface of an upper wafer is contiguous with the upper surface of the next lower wafer when assembled in a vertical manner. In this position, the inner periphery of the lower surface in the upper wafer is congruent, that is, substantially coincidental with the inner periphery of the upper surface of the next lower wafer. When assembled, the wafers will form a stator with the two opposed grooves 10 and 13 as in a bifoil stator (FIG. 4), which are the female image of the form.

Assembly of the Laminated Stator

The form may be mounted in a suitable fixture and the wafers threaded over the form in a vertical or longitudinal array to form the laminated stator of my invention. They will orient themselves to generate the internal helicoidal grooves of the pitch of the form. The major and minor axes of the bifoils of the surface of the wafers are coincident if helicoidal or axially displaced if straight-sided. For example, the bifoil centers 4 (FIGS. 3–5 and 20) are axially aligned with the central axis of the form. The external surface of the array is a right cylinder corresponding to the external right cylindrical exterior surfaces of the wafers. A casing 17 (FIGS. 8 and 9) is passed over the wafer to form a housing for the stator. In order to secure the wafers against displacement, they are secured by fastening means.

Various fastening means may be employed, but the final selection of the means depends in each case on the use to which the transducer will be put. The fixture for assembly of the wafer may be adapted to the fastening means.

When employing the securing means shown in FIG. 21, I may use the equipment illustrated in FIGS. 8 and 9.

The form 14 is fitted with upper and lower coaxial bosses, each formed of a squared boss 23 and 24, and a threaded stud 25 and 26. The corner edges are aligned. The form is set in a base 27 in a suitable holding fixture not shown, and the base 27 has a circular groove 28. The base 27 is provided with diametrically positioned bores 29 and a squared opening 30 designed to receive the squared boss 23.

The casing 17 has an internal diameter to fit over the wafers and an external surface which fits into the groove 28. It is passed over the array of wafers and seated on the base 27.

The cap 31 is provided with a suitable square opening 32 and bores 34 axially aligned with bores 29. The cap 31 is mounted over the top of the array and the bosses. The top of the casing 17 fits into the groove 33. Nuts 35 and 36 are screwed onto the studs 25 and 26 to hold the array.

The array of wafers is bored to produce a pair of bores 37, on each side of the wafer and diametrically opposed from each other. The bores 29 and 34 in the base and cap may be used as a jig to index the bores 37. A drill bushing of suitable diameter may be inserted in bore 34 for this purpose. A pin 38, threaded at each end may then be passed through each of the bores 37, and the nuts 39 are passed through the bores 29 and 34 and screwed on the threaded ends of the pins. The nuts 35 and 36 may be removed and the base 27 and cap 31 removed.

This method and device for securing the wafers in the array have the advantage that the array may be disassembled by removing the pins. It is thus a readily disassembled array.

Where the array is to be more permanently assembled, I may use the apparatus and method of assembly shown in FIGS. 8 and 9 modified as shown in FIGS. 22 and 23. In such case the bores 37 and rods 38 are omitted and the base 27 and cap 31 of FIG. 8 need not be used. The base and cap are modified. The base and the cap may be grooved at 28 and 33 to receive the casing 17. The base and cap carry the square holes as described in connection with FIGS. 8 and 9.

The wafers are threaded over the form as shown in FIGS. 8 and 9. The form is secured by the nuts 35 and 36. The wafers are seated on the base 27 as shown in FIGS. 8 and 9. The cap 31 is similarly mounted and the nut 35 secured to compress the wafers.

In FIGS. 22 and 23, the casing is slotted at diametrically opposed positions at 43 and a corresponding notch formed at 44 in the wafers at each slot. A key 45 is placed in each of the slots to fit into each of the diametrically opposed grooves 43 and secured by welding when using metallic wafers.

Instead of the key, the slots and grooves may be filled by weld metal.

While the locking device of FIG. 22 is more difficult to disassemble, the stator, however, may be disassembled by removal of the weld by heat or machining operation. The wafers may then be disassembled.

Where the helicoidal wafer is formed of uncured rubber or where a helicoidal wafer is rubber-coated, the wafer may be assembled as described in connection with FIGS. 8, 9, 16 and 17. They may be coated with a liner of rubber, particularly where they are metallic. This method not only forms a helicoidal liner of the pitch of the desired stator, but also forms an additional bond between the wafers.

The base and cap are modified as shown in FIG. 24. The base 46 is formed with the squared openings as in FIGS. 8 and 9 and is provided with waste ports 48, circular groove 49 and bores 50. The form 54 carrying the squared stud 51 and threaded stud 52 is mounted in the squared opening 53 in the base 46, which is mounted in a holding fixture not shown. The polyfoil wafers (see FIGS. 8, 9, 16 and 17) are threaded over the form 54, which has been coated with mold release. The wafers 55 are threaded over the form in a vertical array. The casing 56, whose interior has been coated with rubber cement, is passed over the array and sealed in the circular groove 49. The cap 58 which carries the square bore 59 is entered over the square stud 60 at the top of the form 54, whose corners are aligned with the corners of the square stud 51. The cap carries bores 61, whose axis is related to the corners of the squared bores 59 in the same relationship as the axis of the bores 50 to the corners of the square bore 53 in the base 46. The bores 61 are thus axially aligned with the bores 50.

The cap carries the exiting ports 62 and the counter bores 63. The spacer tubes 64 are mounted in the counter bores. The extruder cylinder 65 is formed with ports 66 and counter bores 67 and bores 68, whose diameter is that of the counter bores 63. The relation of the axis of the bores to the axis of the counter bores, is that of the counter bores 63 to the bores 61. When the extruder cylinder is mounted on the separator for tubes 64, the bores 68 are aligned with bores 61 and 50. The rods 69 are entered into the aligned ports and the wafer array is compressed by the nuts 70.

The extruder cylinder is filled with a suitable mass of uncured rubber compound. Force is applied to the piston by a hydraulic ram. The rubber is forced into casing 56 and enters to fill all openings in the wafer array. By regulating the tension on the rods 69, the compressive force on the wafers may be regulated. Where no tension is imposed so that some separation of the wafers is permitted, the rubber will enter between the wafers. The wafer array may then be compressed to the desired degree by taking up the nuts 70.

The nuts 71 may then be threaded down onto cap 58 to hold the compressive force and the nuts 72 removed and the extruder removed. The array may then be entered into an autoclave and cured. After curing, the cap and base are disassembled from the array and the form removed by unthreading it from the array.

As will be described below, the straight-sided wafer contacts the surface of the rotor at limited regions of the rotor. Where it is desired that the straight-sided wafer array have an internal surface which is truly helicoidal, I may employ the straight-sided wafer to provide a mold. The mold is filled with the rubber compound using a helicoidal form acting in conjunction with the wafer array.

FIG. 25 illustrates such a procedure. While this procedure is described in connection with a bifoil wafer, it is also applicable to wafers of the polyfoil cross section such as referred to above. The array of metallic wafers, for example, as described in connection with FIG. 9, preferably secured as in FIG. 22, is separated from the form as described above. The major and minor axis of the straight-sided wafer are for this purpose made to exceed the major and minor axes of the stator to be formed. The inner surfaces of the wafers are coated with a rubber cement such as is used conventionally in molding of unitary rubber stators.

A second form is coated with mold release material such as is used in conventional molding of rubber articles such as stators in the prior art. The second form has the pitch and major and minor axes of the stator to be formed and is mounted in a base. The form 73 has this pitch and a bifoil cross section, i.e., the major and minor axes of the stator to be formed. For example, it may be a bifoil. It is mounted centrally in the base 74 by means of the squared portion of the studs 75 in squared holes 76 in base 74, designed to receive the form and space it uniformally from the interior wall of the wafer array.

A space 77 is thus provided which is of uniform width around and along the form. A cap 78 is set over the stud 79 in squared hole 80 in cap 78, aligned with hole 76, and the assembly is secured by the nuts 81 and 82. The cap 78 is provided with a number of injection orifices 83 spaced about thhe cap 78 and in registry with the space 77. They are connected to an extruder 84. The waste orifices 85 are connected with the space 77 and are positioned about the base 74.

The desired thickness of the coat will determine the width of the space 77. The space is of a width which when added to the major and minor axes of the wafer will give a stator whose major axis will include the necessary eccentricity and a minor axis which is substantially equal to the diameter of the rotor to be employed. If an interference fit between the rotor and the stator is required, the width of the space 77 is made such that when subtracted twice from the major axis of the wafer bifoil, the resulting major axis is less than the distance ($D_r + nE$), where $D_r$) is the diameter of the rotor. For example, the width of the space 77 may be in the range of one-sixteenth inch to one-fourth inch for a transducer employing a 2inch diameter rotor. This dimension is given merely as an illustration.

When using the stators formed according to the procedure of FIG. 25, I prefer to employ metallic wafers and to provide a lining of such thickness that the resulting stator has a polyfoil opening, for example, a bifoil opening. Where in the case of a bifoil stator an interference fit is desired, the minor axis of the bifoil is made less than the rotor diameter by the amount of the interference fit; for example, in the 6½inch motor referred to above, it may be 0.020 to about 0.040 inch total interference.

After injection, the stator injection assembly as shown in FIG. 25 is disconnected from the extruder 63 and heated in a curing oven at a temperature and time such as, for example, used in curing rubber stators in the prior art.

The techniques of rubber formulation, extrusion, and curing elastomers in producing rubber compounds in the prior art are well known to those skilled in the art of rubber molding such as in stator construction.

The stator formed according to the procedure described above has a number of advantages over the prior art helicoidal stators formed entirely of rubber compound encased in a cylindrical housing. When the stator-rotor assembly is being used as a transducer, the rubber in the stator of my invention acts as does that of the conventional stator; however, the rubber mass is largely reduced. It is replaced in major amount by the metallic wafer.

This reduces the hysteresis in the rubber compound because of the reduced rubber mass. The thermal conductivity of the stator is greater because of the large mass of metallic wafer. In all these respects the stator formed according to the above procedure is an improvement on the prior art.

The Transducer

The transducer is formed by assembling the novel stator of my invention with a conventional rotor as described in connection with FIGS. 1–5 above.

The stator of my invention has the additional advantage over prior art unitary stator in that the sections which fail may be replaced without discarding the entire stator.

The stator, formed of wafers with straight-sided interior wall, imposes a lower friction load with the rotor than the prior art stators. The rotor at each wafer is substantially in point contact with the adjacent surface of the stator and may be lubricated by the fluid used to power the rotor where the transducer is a motor or the pumped fluid when the transducer is a pump. Since the contact area is limited, the grinding effect of particulate matter is limited to the erosive effect of fluid velocity. By proper design, the leakage factor may be made less than that experienced by the conventional unitary stator-rotor combination when the rotor does not make an interference fit with the stator.

As will appear below, the leakage factor depends on fraction of the pitch length which is subtended by the wafer.

The leakage occurs in a bifoil stator because of the space between the straight side of the wafer and adjacent helicoidal surface of the rotor at one end of the bifoil. This space is herein referred to as the bypass space. Since the seal between adjacent wafers described above is substantially a point seal, the spaces communicate with each other as well as the open area on the other end of the bifoil, that is, the cavities of the progressing cavity transducer.

However, since the effective cross-sectional area of the bypass path is but a small fraction of the total effective cross-sectional area, the impedance to flow between the bypass spaces in the wafers, from the top to the bottom of the stator, is much greater than that through the progressing cavities. For that reason, the percent leakage which will be experienced is substantially less than is the ratio of the effective cross-sectional area of the bypass space to that of the progressive cavities. The bypass spaces act as a labyrinth seal to effectively inhibit leakage and reduction in efficiency.

FIGS. 27–29 illustrate the above relation. FIGS. 27, 28 and 29 show a part of the straight-sided wafer array in which a rotor 86 is mounted. In FIG. 28, the peripheral bifoil edge of the upper surface of the wafer 88 is at 87. The contact at the peripheral bifoil edge 90 of the upper surface 91 of the next lower wafer 92 is displaced clockwise through the angle ($a$) (see Equation 1) described above. The contact at the peripheral bifoil edge 93 of the upper surface of the next lower wafer 94 is also displaced an additional angle ($a$). The contact at the peripheral bifoil edge 95 of the upper surface 96 of the next lower wafer 97 also is displaced an additional angle ($a$). The contact at the peripheral bifoil edge 98 of the upper surface 99 of the next lower wafer 100 is also displaced an additional angle ($a$).

The minor axis 6 of the straight-sided wafer (see FIGS. 1–5) is greater than the diameter of the rotor ($D_r$). FIGS. 28 and 29 illustrate the position of a portion of one quadrant of the rotor helix at one position of the eccentric rotary motion of the rotor. In the position shown on FIGS. 27 and 28, the rotor contacts each wafer at one position. The point of contact is at the upper surface of the wafer.

The rotor at the same position of its motion, but spaced 180 degrees of the helix from the position shown in FIG. 28 will contact the wafer bifoil at its edge at the lower surface, see FIG. 29. The rotor contacts the bifoil in the lower surface of wafer 88*a* at 87*a*, of wafer 92*a* at 91*a*, of wafer 94*a* at 93*a*, of wafer 97*a* at 95*a*, and of wafer 100*a* at 98*a*. This relation is repeated through the longitudinal array of wafers.

When the rotor translates from the arc 1 (FIGS. 2–4) to the opposite end position of the bifoil at arc 2, the contact points are reversed, as can be seen from FIGS. 27, 28, and 29.

The minor axis of the wafer ($D_s$), i.e., 6, is larger than the diameter of the rotor ($D_r$) by an amount depending on the height ($h$) of the wafer and the pitch of the stator ($P_s$).

The height of the straight-sided wafer is given by the relation:

$$a = \frac{360^\circ h}{P_s} \qquad \text{(See Equation 1)}$$

The distance $$d = D_s - D_r = \frac{n}{2} E \sin a \qquad \text{(See FIG. 20)}$$

where ($D_s$) is the minor axis of the stator bifoil and ($D_r$) is the diameter on the rotor.

The efficiency factor (K) is a function of the ratio of the bypass cross section to the total cross section of the stator bifoil.

This ratio (K) is defined by the equation:

$$K = \frac{\frac{nE}{2}\sin\left[\frac{360^\circ h}{P_s}\right] \times \left[nE + \frac{\pi D_r}{2}\right]}{\left[nE\,D_r + \frac{\pi D_r^2}{4}\right]} \qquad \text{Equation 5}$$

In order to keep the leakage at 5 percent or less, and preferably less, for example, about 2 percent, I design the wafer and the thickness of the wafer so that the above ratio is not more than 0.05, and preferably 0.02 or less. The efficiency factor K will then be 95 percent or more; for example, 98 percent or more. As an illustration of my invention and not as a limitation thereof, the following will indicate the described relationship.

Assume a stator described above with a 42-inch pitch ($P_s$) using a rotor of 2 inches diameter ($D_r$) and an (E) value of 0.5 inch, with $n$ equal 4.

For a ⅛inch wafer ($h$) the above ratio is equal to 0.0134, that is, the leakage ratio is about 1.34 percent, and the efficiency factor K is about 98.66 percent.

For practical assembly purposes and uses in transducers, wafers of one-eighth inch and smaller height ($h$), for example, one thirty-second inch wafers, the suitable ratio of $h/P_s = h/2P_r$ is from about $3 \times 10^{-3}$ to about $8 \times 10^{-4}$.

When using the stators formed according to the procedure of FIG. 25, I prefer to employ metallic wafers and to provide a lining of such thickness so that the resulting stator has a polyfoil opening, for example, a bifoil opening, whose minor axis is not substantially less than the diameter of the rotor which is used with the stator in the transducer as described above. Where an interference fit is desired, the minor axis of the bifoil is made less than the rotor diameter by the amount of the interference fit; for example, in the 6½inch motor referred to above, it may be 0.020 to 0.040-inch total interference.

In the case of the stator employing the helicoidal wafer, I prefer the procedure of FIG. 24. In the case of the straight-sided wafer, I prefer the procedure of FIG. 25.

FIGS. 30*a* and 30*b* show schematically an application of my invention to an in-hole motor. The motor assembly 201 is connected to the drill string 202 through the bypass valve 203. As shown in the schematic FIGS. 30*a* and 30*b*, the motor is composed of a stator-rotor assembly forming elements of the motor.

The stator 204 in the containing tubular housing casing 205 is laminar as previously described. The stators contain a rotor 206. It is free and not connected to any members at its upper end 207. The lower end of the rotor is connected by the universal joint 208 to the connecting rod 210. The universal joint 209 connects the connecting rod to the hollow tubular drive shaft 211. The universal joints may be as shown in the above Garrison patent or in the Neilson et al. U.S. Pat. No. 3,260,069 or 3,260,318. The hollow drive shaft 211 which carries a suitable port 211' is positioned within the bearing housing 212 by means of upper radial bearing 213 and lower radial bearing 214, such as shown in the above Garrison patent and preferably in a copending application of applicant and Ser. No. 388,586. whose function is as is conventional for this type of drill, as shown in the above Garrison or Neilson patents or such as is described in my co-pending applications Ser. No. 354,954 and 385,836, which are herewith incorporated by this reference.

Drilling mud, as is usually employed in this type of drilling operation, is introduced through the drill strings 202 and through the bypass valve 203; and it passes into the upper end of the stator, around the rotor 206, discharges from the stator to pass through the connecting rod housing 205' around the connecting rod 210 and enters the ports 211' in the tubular drive shaft 211. Part may be bypassed around the shaft 211 and through longitudinal grooves in the upper radial bearing 213 and around the thrust bearings 212' and the grooves of the lower radial bearing 214 and discharge from the end of the bearing housing 212. The portion passing through the port 211' passes through the hollow drive shaft 211 to be discharged through the nozzles of the rotary bit 216. It passes upwardly in the bore hole in the annulus between the bore hole and the housings and by the drill string, eventually to reach the top as is conventional in this type of drilling operation.

FIG. 31 shows the application of the laminar stator 301 in a pump 302 in which the rotor 303 is rotated by an external power source and material pumped from the inlet 304 to the outlet 305.

I claim:

1. A stator for a helicoidal progressing cavity transducer comprising a plurality of wafers, each having an internal wall of the same geometric form arranged one after the other in array, each having a polyfoil opening of the same geometry and the same height and the same minor and major axis, the axis of each wafer angularly displaced counterclockwise from the like axis of adjacent wafers in the array of wafers, by an angle $a$ in degrees which is given by the formula:

$$a = \frac{360° h}{P_s}$$

Where $h$ is the thickness of the wafer, ($P_s$) is the length of one pitch of the stator, and means to securely fasten said wafers to each other in said array.

2. The stator of claim 1 in which the opening is a bifoil opening.

3. A stator according to claim 1, in which the internal wall of the wafer is helicoidal of pitch ($P_s$) and the ratio of the thickness ($h$) of the wafer to the pitch of the stator ($P_s$) is in the range of about 0.05 to about $4 \times 10^{-4}$.

4. The stator of claim 3 in which the opening is a bifoil opening.

5. A transducer comprising a stator according to claim 1 in which the internal wall is helicoidal, and a helicoidal rotor having a polyfoil section and a pitch length ($P_r$) one-half the pitch length ($P_s$) of the stator and a circular cross section diameter (D) which is not substantially less than the minor axis of the polyfoil.

6. The transducer of claim 5 in which the polyfoil is a bifoil.

7. The transducer of claim 5, in which the internal wall of the wafer is helicoidal of pitch ($P_s$) and in which the opening is a bifoil opening the ratio of the thickness of the wafer ($h$) to the pitch of the stator ($P_s$) is in the range of about 0.05 to about $4 \times 10^{-4}$.

8. The transducer of claim 7 in which the polyfoil is a bifoil.

9. A method of forming a laminated stator which comprises mounting a form having a helicoidal surface of pitch ($P_s$) and whose cross section through its length contains a polyfoil opening of uniform geometry and dimensions, assembling in a longitudinal array on the said form, a plurality of wafers having an opening of the same polyfoil geometry and having an internal helicoidal wall surface of substantially of the pitch of said form, and having thickness ($h$), which is a small fraction of the said pitch ($P_s$), securing said wafers to each other against angular displacement, removing said form from said longitudinal array.

10. The method of claim 9, in which the ratio of the thickness of the wafer to the pitch of the form is in the range of about 0.05 to about $4 \times 10^{-4}$.

11. The method of claim 9, in which the wafer has a bifoil opening and the form has a bifoil cross section and said wafer has major and axes greater than than the major and minor axes of the bifoil cross section of said form.

12. The method of claim 9, which comprises inserting into said array of wafers a second form, having the same helicoidal geometric formation as said first-named form but having a smaller cross-sectional major and minor axis, positioning said second form centrally of the wafer polyfoil opening of said array to form a uniform space between the internal surface of said wafer array and said second form, injecting elastomeric compound into the said space to form a uniform lining between the internal surface of said array of wafers and the external surface of said second form, curing said lining and withdrawing said second core.

13. The method of claim 12 in which said polyfoil opening is a bifoil opening.

14. The method of claim 9, which comprises inserting into said array of wafers a second form, having the same helicoidal geometric formation as said first-named form but having a smaller cross-sectional major and minor axis, positioning said second form centrally of the wafer polyfoil opening of said array to form a uniform space between the internal surface of said wafer array and said second form, injecting elastomeric compound into the said space to form a uniform lining between the internal surface of said array of wafers and the external surface of said second form, curing said lining and withdrawing said second core.

15. The method of claim 14 in which said polyfoil wafer opening is a bifoil opening.

16. A method of forming a laminated stator which comprises mounting a form having a helicoidal surface of pitch ($P_s$) and whose cross section through its length contains a polyfoil opening of uniform geometry and dimensions, assembling in a longitudinal array on the said form, a plurality of wafers having an opening of the same polyfoil geometry having thickness ($h$), which is a small fraction of the said pitch ($P_s$), securing said wafers to each other against angular displacement, removing said form from said longitudinal array.

17. The method of claim 16, in which the ratio of the thickness of the wafer to the pitch of the form is in the range of about 0.05 to about $4 \times 10^{-4}$.

18. The method of claim 16, in which the wafer has a bifoil opening and the form has a bifoil cross section and said wafer has major and axes greater than major and minor axes of the bifoil cross section of said form.

19. The method of claim 16, which comprises inserting into said array of wafers a second form, having the same helicoidal geometric formation as said first-named form but having a smaller cross-sectional major and minor axis, positioning said second form centrally of the wafer polyfoil opening of said array to form a uniform space between the internal surface of said wafer array and said second form, injecting elastomeric compound into the said space to form a uniform lining between the internal surface of said array of wafers and the external surface of said second form, curing said lining and withdrawing said second core.

20. The method of claim 19, in which the opening is of a bifoil geometry.

21. A method of forming a laminated stator which comprises mounting a form having a helicoidal surface of pitch ($P_s$) and whose cross section through its length contains a polyfoil opening of uniform geometry and dimensions, assembling in a longitudinal array on the said form, a plurality of wafers having an opening of the same polyfoil geometry and having thickness ($h$), which is a small fraction of the said pitch $P_s$, securing said wafers to each other against angular displacement, injecting elastomeric compound into said array, and curing said elastomeric compound in said array.

22. The method of claim 21 in which said opening is of bifoil geometry.

23. A method of forming a laminated stator which comprises mounting a form having a helicoidal surface of pitch ($P_s$) and whose cross section through its length contains a polyfoil opening of uniform geometry and dimensions, assembling in a longitudinal array on the said form, a plurality of wafers having an internal helicoidal wall and an opening of the same polyfoil geometry and having thickness ($h$), which is a small fraction of the said pitch $P_s$, securing said wafers to each other against angular displacement, injecting elastomeric compound into said array, and curing said elastomeric compound in said array.

24. The method of claim 23 in which said opening is a bifoil opening.

* * * * *

UNITED STATES PATENT OFFICE

CERTIFICATE OF CORRECTION

PATENT NO. : 3,975,120

DATED : August 17, 1976

INVENTOR(S) : JOHN E. TSCHIRKY

It is certified that error appears in the above-identified patent and that said Letters Patent are hereby corrected as shown below:

Column 1 line 50 - change "125" to --124--.
Column 3 line 50 - change "inches" to --inch--.
Column 3 line 54 - change "1-3/4 inches" to --1-3/4 inch--.
Column 9 line 40 - change "capacity" to --cavity--.
Column 9 line 48 - change "axis" to --axes--.
Column 9 line 55 - change "surface" to --surfaces--.
Column 13 line 65 - change "thhe" to --the--.
Column 18 line 30 - claim 11 (line 3 of the claim), after "major and" add --minor--. See Examiner's amendment of 3/19/76.

Col 18, Line 30 (same line)- delete the second "than". See line 3 of claim 11, page 35 of the claim as originally filed.

Signed and Sealed this

Twelfth Day of April 1977

[SEAL]

*Attest:*

RUTH C. MASON
*Attesting Officer*

C. MARSHALL DANN
*Commissioner of Patents and Trademarks*